US006421932B2

(12) United States Patent
Gommori et al.

(10) Patent No.: US 6,421,932 B2
(45) Date of Patent: Jul. 23, 2002

(54) METHOD AND APPARATUS FOR DRYING SUBSTRATE PLATES

(75) Inventors: Kazuhiko Gommori, Ninomiya-machi; Kazuto Kinoshita, Tsukuba; Isamu Akiba, Hitachi; Masao Sugiyama, Ninomiya-machi, all of (JP)

(73) Assignee: Hitachi Electronics Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/780,498

(22) Filed: Feb. 12, 2001

(30) Foreign Application Priority Data

Feb. 14, 2000 (JP) ..... 12-034755
Sep. 29, 2000 (JP) ..... 12-298615

(51) Int. Cl.[7] ..... F26B 3/00

(52) U.S. Cl. ..... 34/488; 34/461; 34/464; 34/84; 34/230

(58) Field of Search ..... 34/461, 463, 464, 34/487, 488, 508, 83, 84, 210, 230

(56) References Cited

U.S. PATENT DOCUMENTS 6,073,369 A * 6/2000 Yasuyuki ..... 34/651
6,267,853 B1 * 4/2001 Dordi et al. ..... 204/232

FOREIGN PATENT DOCUMENTS

JP 2001050660 * 2/2001

OTHER PUBLICATIONS

U.S. application No. 09/579,134, filed May 30, 2000, pending.
U.S. application No. 09/780,498, filed Feb. 12, 2001, pending.

* cited by examiner

*Primary Examiner*—Pamela Wilson
(74) *Attorney, Agent, or Firm*—Oblon, Spivak, McClelland, Maier & Neustad, P.C.

(57) ABSTRACT

While being transferred in substantially horizontal state along a predetermined path of transfer by a conveyer means, a substrate plate is dried by a jet of compressed air which is spurted out from a slit-like mouth of an air knife nozzle crosswise of the entire width of the substrate plate and at a predetermined angle of incidence with respect to a drying surface of the substrate plate to scrape off a liquid. The angle of incidence of jet air is made shallower as soon as the substrate on the conveyer means comes to a point of entry to an air blasting zone and is made deeper at latest when the substrate plate comes to a position immediately before a point of disengagement from the air blasting zone.

11 Claims, 9 Drawing Sheets

METHOD AND APPARATUS FOR DRYING SUBSTRATE PLATES

BACKGROUND OF THE INVENTION

1. Field of the Art

This invention relates to a method and an apparatus for drying substrate plates, for example, thin substrate plates of a rectangular shape as used for LCD (liquid-crystal display) panels or thin substrate plates of a circular shape.

2. Prior Art

For instance, a TFT (thin film transistor) type LCD panel generally employs a couple of glass plates as substrates, i.e., a TFT substrate and a color filter substrate. In the fabrication process of TFT substrates, TFT elements are formed on the surface of a glass plate by successively processing same through a number of steps such as formation of a thin film layer, formation of a resist film layer, exposure to light, development, etching and defoliation of the resist film. While being processed through these steps, each TFT substrate needs to be washed and dried repeatedly before or after each step. Similarly, color filters are formed on thin glass plates by a photolithography process or the like, in which each color filter substrate needs to be washed and dried repeatedly as a pretreatment before respective steps of the fabrication process. Aside from the TFT type, LCD panels or other rectangular substrate plates of glass or of synthetic resin are often required to be washed and dried before proceeding to a predetermined treatment of a fabrication process.

For drying washed substrate plates of this sort, there have been known various methods in the art. In order to continuously wash and dry substrates which are transferred on a processing line, namely, in the case of the so-called in-line processing, it has been the general practice to employ a drying method utilizing air knife effects, for example, an air knife drying method as described below.

Normally, substrate plates are transferred by a roller or belt conveyer, with faces of the respective substrate plates in a horizontal position or in a slightly tilted state in a lateral direction or in a direction perpendicular to the substrate transfer direction, and an air blasting zone is at a predetermined position in a substrate transfer path. Located in the air blasting zone is an air knife which is so disposed as to confront face to face successively with substrate plates being transferred. The air knife is provided with a nozzle mouth in the form of a narrow slit-like opening to spurt out jet air under high pressure in the fashion of a knife blade across the width of the substrate plates thereby to scrape droplets or liquid films off the surfaces of the substrate plates.

In this regard, jet ai is spurted out from the air knife nozzle from a direction opposite to the substrate transfer direction and at an angle smaller than 90 degrees, preferably, at a shallow angle of 45 degrees or smaller than 45 degrees. Besides, the nozzle mouth is located in the vicinity of substrate surfaces, so that jet air which is spurted out in the shape of a thin knife blade is impinged on substrate surfaces. As a result, liquids which have deposited on the substrate surfaces are pushed rearward in the substrate transfer direction under the pressure of the jet air and finally purged from rear edge portions of the substrate.

In this connection, in order to remove liquids and moisture from substrate surfaces in transfer more smoothly and in a more reliable manner, it is desirable to locate an air knife nozzle in a plane which is parallel with the substrate transfer surface of the conveyer, and at the same time to locate the air knife nozzle in an angularly inclined position relative to a direction perpendicularly intersecting the substrate transfer direction to spurt jet air toward substrate surfaces from a slant direction. When so located, liquid films and droplets on a substrate surface are pushed by the pressure of jet air not in a direction parallel with the substrate transfer direction but in an askew direction which corresponds to the inclination angle of the air knife nozzle. Therefore, liquids are urged to leave a substrate from rear end edge portion and from posterior side edge portions, smoothly and quickly after flowing over shortened distances along the surface of the substrate.

In order to more efficiently peel off liquid films from the surface of a substrate by the use of an air knife, it is desirable to blast jet air on substrate surfaces with as shallow an angle of incidence as possible. This is important especially at the time when a leading end of a substrate plate enters an air blasting zone of an air knife, because blasting of jet air at a deep angle of incidence will result in increased possibilities of liquid being scattered around under the pressure of jet air. Therefore, it is desirable for jet air to be impinged on substrate surfaces with as shallow an angle of incidence as possible. In this regard, the term "a shallow angle of incidence" means an angle which is nearly parallel with a substrate surface, while the term "a deep angle of incidence" means an angle which is nearly normal to a substrate surface.

In the drying stage using an air knife nozzle, liquids on the surface of a substrate plate are caused to gather in a rear corner portion of the substrate plate at a point immediately before a final liquid purging position where the substrate plate leaves the air blasting zone of the air knife. However, in that corner portion, the substrate plate no longer has a surface for guiding the gathered liquids. Therefore, especially in a case where a liquid deposits on substrate surfaces in a relatively large quantity, it may become difficult to apply the pressure of jet air effectively for completely purging the gathered liquid from corner portions of the substrate plates. If the substrate plates with liquid residues in corner portions are sent forward to a next stage of the fabrication process, the residual liquid can be caused to flow back onto the substrate surfaces by vibrations to which the substrate plates are subjected in the course of the transfer to a next processing state, contaminating the once-dried substrate surfaces again by developing stains or the like thereon. The liquid can be purged to a satisfactory degree in a case of substrate plates of small sizes on which the liquid concentration in corner portions is relatively small. Alternatively, the liquid can be purged completely from corner portions of the substrates if the substrate transfer speed is slowed down sufficiently for this purpose.

In the fabrication process of LCD panels, however, from the standpoint of production efficiency, it is the general practice to produce a mother or matrix of a large size, which is later cut into a unit size corresponding to the size of individual LCD panels to be produced. Recently, due to increasing demands for LCD panels of larger sizes, there has been a conspicuous trend toward employing mother substrate plates of larger sizes. Similarly, in the fabrication process of large mother plates, the respective plates are repeatedly washed and dried, utilizing the air knife effects in each drying stage. Therefore, it has become necessary for an air knife nozzle to be able to dry substrate plates of large sizes completely and in a reliable manner. On the other hand, in view of the effects on the productivity of LCD panel processing lines, namely, in view of conspicuous degradations in substrate processing efficiency as a whole, it is undesirable to slow down the substrate transfer speed through a drying stage. For these reasons, there has been a great demand for development of an apparatus which can dry substrate plates of large sizes in a secure and reliable manner while being transferred at high speed from one stage to another of a processing line.

SUMMARY OF THE INVENTION

With the foregoing situations in view, it is an object of the present invention to provide high precision drying method and apparatus which can dry substrate plates by means of air knife effects quickly in an efficient manner and entirely including rear corner portions of the respective substrate plates.

It is another object of the present invention to provide drying method and apparatus which can dry substrate plate surfaces by air knife effects, free of stains as caused by a spatter of a residual liquid.

It is still another object of the present invention to provide drying method and apparatus which can dry substrate plates, particularly, substrate plates of large sizes quickly in a reliable manner while the substrate plates are being transferred at high speed from one stage to another of a processing line.

According to the present invention, for achieving the above-stated objectives, there is provided an apparatus for drying a substrate plate which is being transferred substantially horizontally by a conveyer means along a predetermined path of transfer, by the use of an air knife nozzle having a slit-like nozzle mouth located at a uniform distance from a drying surface of the substrate plate to spurt a jet of compressed air across width of the substrate plates at a predetermined angle of incidence with respect to a drying surface of the substrate plate from a direction opposite to a transfer direction of the substrate plate to scrape off liquid droplets and films therefrom, characterized in that the apparatus comprises: an incident air angle control means associated with the air knife nozzle to adjust the angle of incidence of jet air with respect to the drying surface of the substrate plate, the incident air angle control means being adapted to make the angle of incidence shallower as soon as the substrate plate reaches a point of entry into an air blasting zone of the air knife nozzle and to make the angle of incidence deeper at latest immediately before the substrate plate reaches a point of disengagement from the air blasting zone.

In this instance, it is desirable for the air knife nozzle to be located obliquely in a plane parallel with a substrate transfer surface of the conveyer means. The incident air angle control means can be constituted either by a descending air angle control means which is adapted to turn the air knife nozzle to vary a descending angle of jet air spurted from the air knife nozzle, or by a current rectifying plate which is located at one side of the path of transfer of the conveyer means in such a way as to make the angle of incidence shallower when the substrate plate comes to a point of entry to the air blasting zone of the air knife nozzle. If desired, these two different types of incident air angle control means can be employed in combination.

In a specific form of the present invention, the descending air angle control means comprises a pair of rotational shafts which are attached to the air knife nozzle in parallel relation with the nozzle mouth to rotatably support the air knife nozzle on a bracket, and a rotational drive means like a pulse motor which is coupled with one of the rotational shafts. Preferably, the descending air control means is adapted to adjust the air descending angle to an angle smaller than 45 degrees at a point of entry of the substrate plate into the air blasting zone of the air knife nozzle, and to an angle larger than 45 degrees at the time of disengagement of the substrate plate from the air blasting zone.

On the other hand, in the case of the current rectifying plate, it is located in the air blasting zone of the air knife nozzle and at one side of the path of transfer of the conveyer means, in parallel relation with side edges of the substrate plate on the side of a leading corner portion thereof to be firstly plunged into the air blasting zone.

The above and other objects, features and advantages of the present invention will become apparent from the following particular description of the invention, taken in conjunction with the accompanying drawings which show by way of example preferred embodiments of the invention. In this regard, it is to be understood that the preferred embodiments are shown for illustration purposes only and not for limiting purposes.

DESCRIPTION OF PREFERRED EMBODIMENTS

Hereafter, the present invention is described more particularly by way of its preferred embodiments with reference to the accompanying drawings. Needless to say, the present invention is not limited to the particular forms shown.

Figure 1:
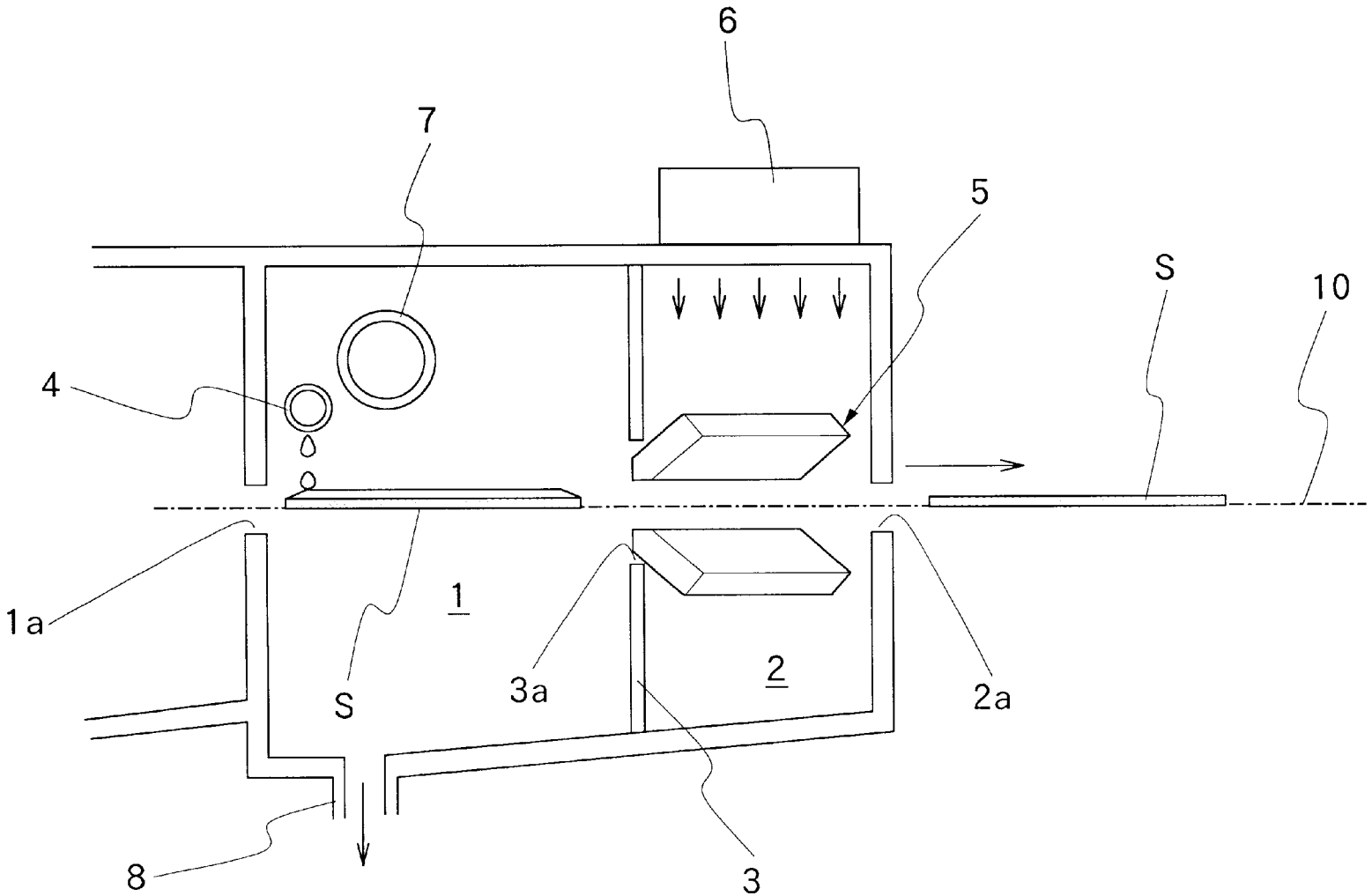
FIG. 1 is a schematic view of a substrate washing and drying mechanism.

Referring first to FIG. 1, there is schematically shown a substrate drying stage, in which indicated at S is a substrate plate which is being passed through a preliminary draining stage 1 and a main drying stage 2. The draining and drying stages 1 and 2 are each defined within a housing and separated from each other by a partition wall 3. The draining stage 1 is provided with an entrance opening 1*a* to receive therethrough substrate plates S which are delivered from a preceding washing stage, while the drying stage 2 is provided with an exit opening 2*a* for dried substrate plates S. The partition wall 3 is provided with a narrow opening 3*a* which constitutes part of a path of transfer of the substrate plates S. Provided in the draining stage 1 is a pure water dripping means 4 thereby to drip pure water onto the substrate plates S, keeping drained substrate surfaces in a uniformly wet state without partially dried areas.

Provided in the drying stage 2 are a couple of air knives 5 which are located opposingly on the upper and lower sides of a path of transfer of the substrate plates S. The drying state 2 is retained in a positively pressurized state to keep off pure water or mist of a washing liquid, while the draining stage 1 is retained in a negatively pressurized state. For this purpose, an atmosphere compressor 6 is provided in the drying stage 2, while a forced exhaust duct 7 is connected to the draining stage 1. Further, a liquid discharge duct 8 is connected to a lower or bottom portion of the draining stage 1.

Figure 2:
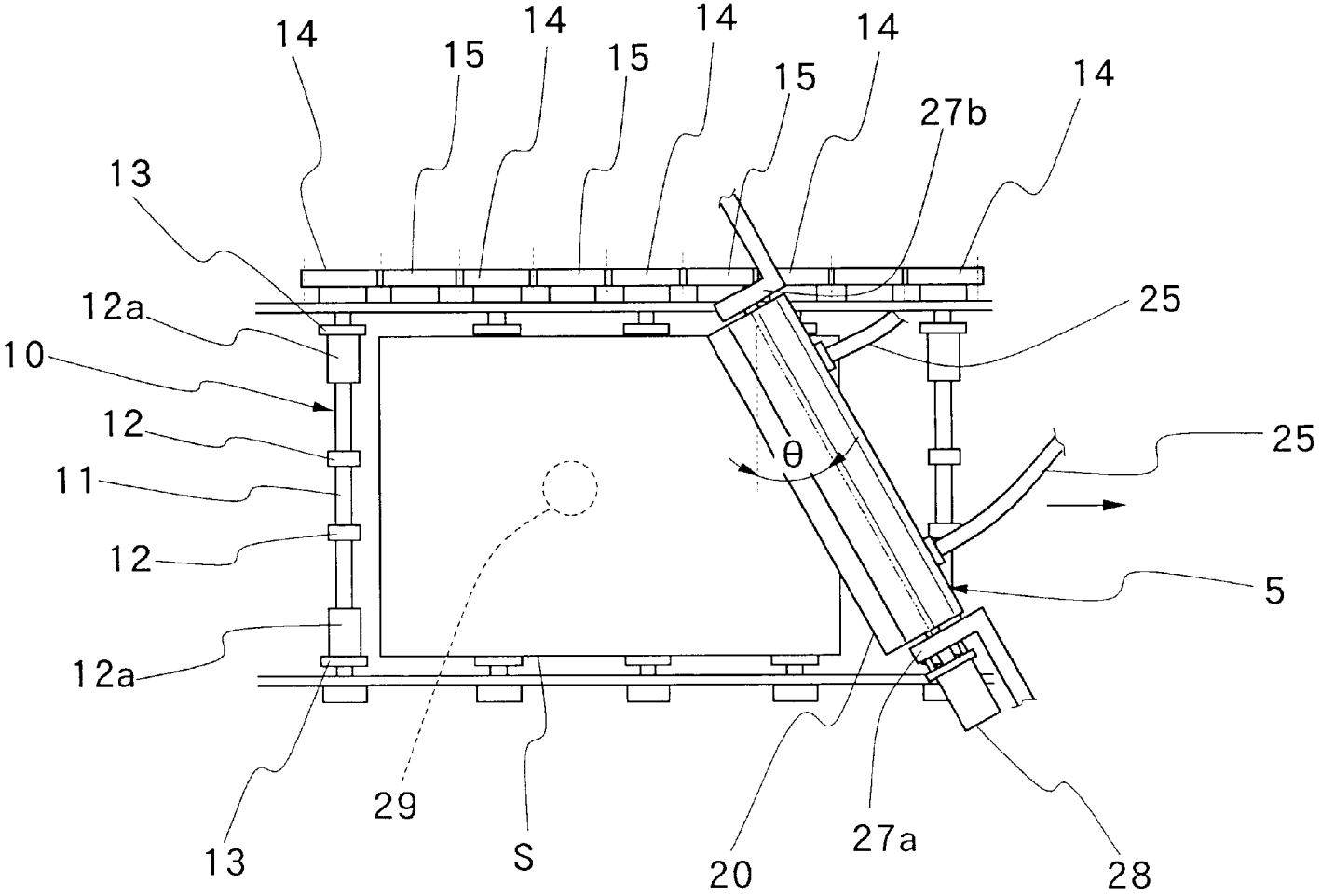
FIG. 2 is a schematic plan view of a substrate plate drier.

In this instance, the substrate plates S are each in the form of a thin rectangular glass plate, and are transferred in a horizontal state or in a slightly laterally tilted state through the drying stage, including the draining stage 1 and the drying stage 2, on the way to a next processing stage on the line. The substrate plates S are transferred by a conveyer means, for example, by a roller conveyer 10 which is arranged as shown in FIG. 2. The roller conveyer 10 is constituted by a plural number of rotational shafts 11 which are rotatably supported at predetermined intervals along a path of transfer of the substrate plates S, and roller members 12 which are provided on each rotational shaft 11 at predetermined intervals along the length of the latter. End rollers 12*a* at the opposite ends of the rotational shaft 11 are provided with a flange portions 13 to be held in abutting engagement with longitudinal 11 sides of the substrate plates S for positioning purposes. Therefore, the substrate plates S are transferred in a forward direction as indicated by an arrow in FIG. 2, with the faces of the respective substrate plates S in a horizontal state. For transferring the substrate plates S, all of the rotational shafts 11 need to be put in rotation at uniform speed. For this purpose, the respective rotational shafts 11 are provided with a gear 14 at one end and coupled with adjacent rotational shafts 11 through a transmission gear 15. Upon rotationally driving one rotational shaft 11, all of the rotational shafts 11 are put in rotation at uniform speed.

Figure 3:
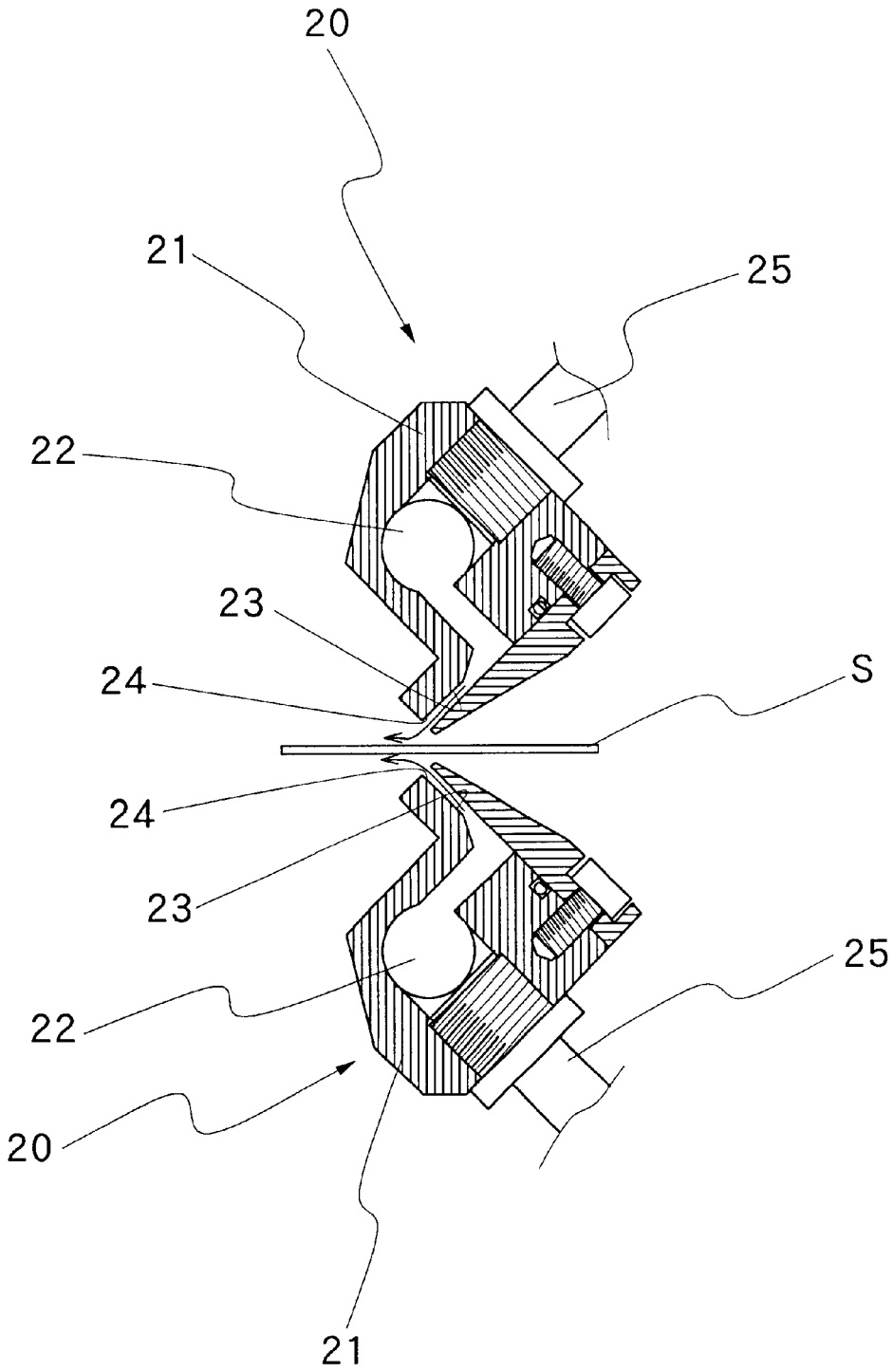
FIG. 3 is a schematic sectional view of an air knife nozzle.
Figure 4:
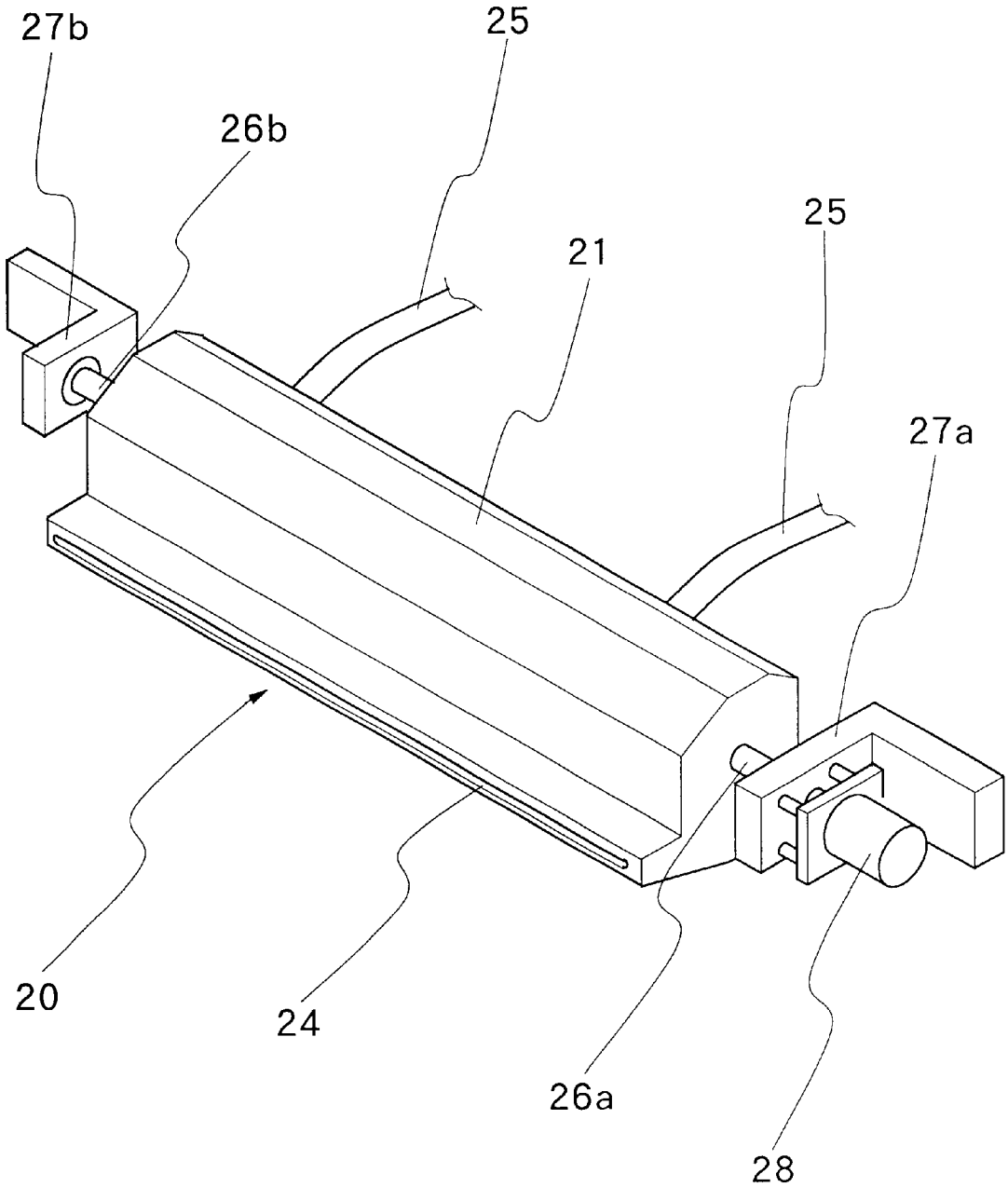
FIG. 4 is a schematic perspective view of the air knife nozzle.

As soon as a substrate plate S is transferred to the drying stage 2 from the draining stage 2 through the opening in the partition wall 3, it is dried from opposite sides by the air knives. FIGS. 3 and 4 show details in construction of a nozzle 20 which is employed by each air knife 5. The air knife nozzle 20 is provided with an elongated tubular casing 21, and a pressurizing chamber 22 is formed internally of the casing 21. Compressed air is introduced into this air pressurizing chamber 22. Formed along one side of the casing 21 is an air outlet passage 23 with a narrow slit-like nozzle hole or mouth 24 at and along its outer end. This air outlet passage 23 has a length which is necessary for rectifying air streams into a linear shape as it is spurted out through the nozzle hole 24. Further, a compressed air supply pipe or pipes 25 are connected to the casing 21 to supply compressed air to the air chamber 22.

Figure 5:
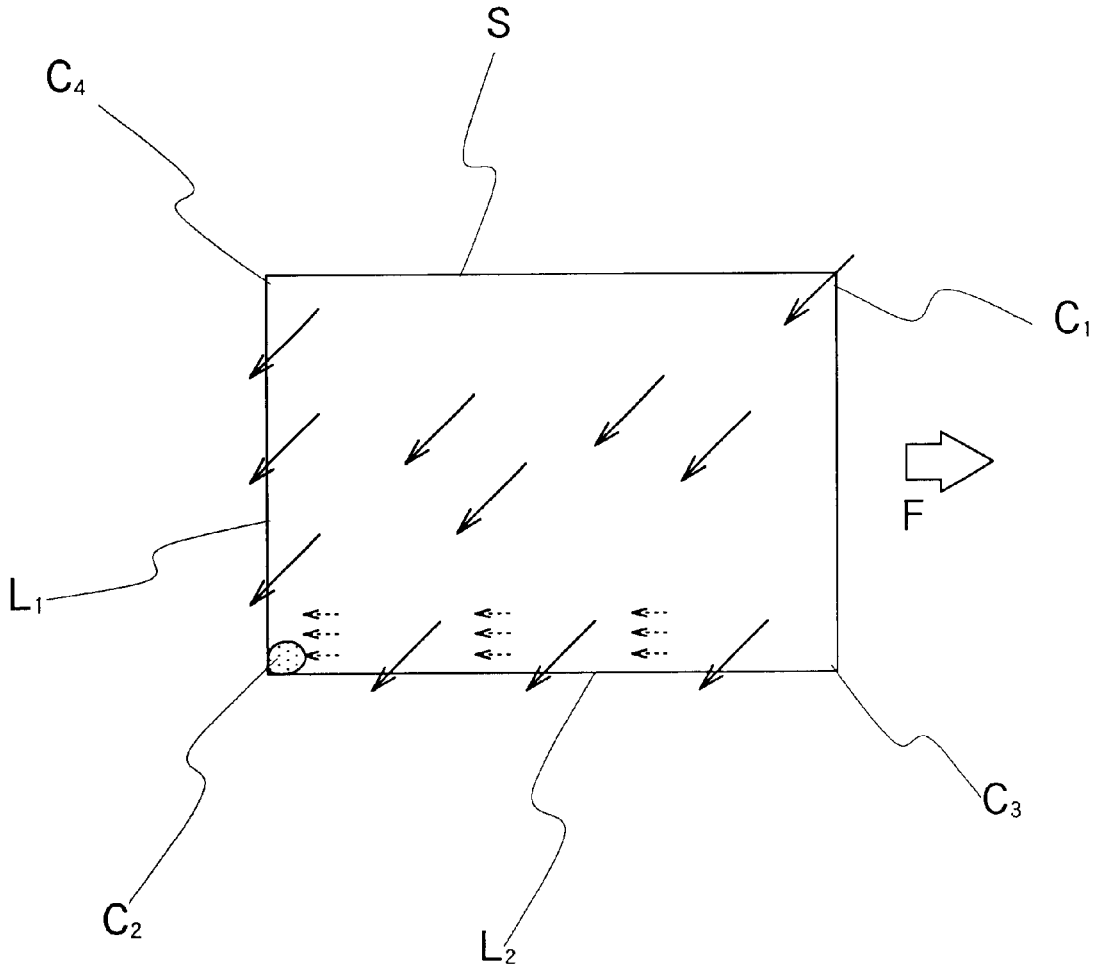
FIG. 5 is a diagrammatic illustration showing acting directions of jet air on the surface of a substrate plate.

The air knife nozzles 20, each with the construction as described above, are located on the upper and lower sides of a path of transfer of substrates S, that is to say, on the upper and lower sides of the conveyer means 10 within the drying stage 2. The nozzle holes 24 of the upper and lower air knife nozzle 20 are so arranged as to blast jet air toward the surfaces of a substrate plate S form uniform distances. The air knife nozzles 20 are not positioned perpendicularly to the substrate transfer direction but are positioned in a plane parallel with the surfaces of substrate plates S in transfer and obliquely with an angle of inclination θ from a direction which perpendicularly intersects the substrate transfer direction. In addition, the nozzle hole 24 of each air knife nozzle 20 has a length which fully covers the entire width of the substrate plates S in a direction perpendicular to the substrate transfer direction. Accordingly, as shown in FIG. 5, each substrate plate S on the conveyer means 10 enters an air blasting zone of the air knife nozzle 20 from its leading corner portion $C_1$ and disengages from or leaves the air blasting zone at its rearmost corner portion $C_2$. In other words, as soon as the air blasting zone is reached by a substrate plate S which is in transfer in the direction F, jet air from the air knife nozzle 20 is blasted on the substrate plate S from the leading corner portion $C_1$. With the progress of the substrate plate S, contact length of jet air with the substrate plate S is gradually increased until jet air is blasted on the entire surfaces of the substrate plate S. Accordingly, liquid droplets and films which deposit on the substrate plate S are swept away in a direction opposite to the substrate transfer direction by the pressure of jet air from the air knife nozzle 20. Since each substrate plate S is positioned angularly relative to the substrate transfer direction, the liquid is swept away in askew directions as indicated by arrows in FIG. 5, and finally purged from the substrate plate S at rear end edges $L_1$ and side edges $L_2$ of one longitudinal side of the substrate plate S. Thus, liquids can be purged from the surfaces of substrate plates S in an extremely efficient manner, so that the substrate plates S are dried one after another as they are passed through the air knife nozzles 20.

Figure 6:
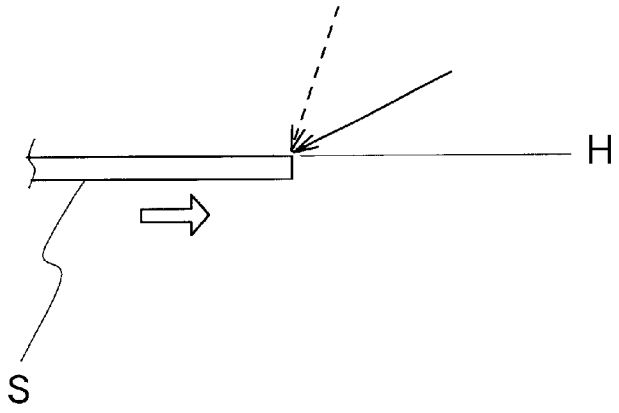
FIG. 6 is a diagrammatic illustration showing the angle of incidence of jet air on a substrate plate entering an air blasting zone of an air knife nozzle.

Before a substrate plate S on the conveyer means comes to a point of entry into the air blasting zone, jet air from the air knife nozzle 20 is allowed to flow straight through the path of transfer of the substrate plates in the absence of any obstacle. However, at the instant when a leading corner portion $C_1$ of a substrate plate S is advanced to plunge into the air blasting area, a liquid on the substrate surfaces may be scattered around by the impacts of jet air. In this regard, the deeper the angle of incidence of jet air with respect to the horizontal surface H of the substrate S at the plunging point (indicated by a broken line in FIG. 6), namely, the closer the angle of incidence of jet air to normal angle, the greater becomes the impacts of jet air against the substrate plate S giving rise to liquid spattering in all directions. In addition, the higher the transfer speed of substrate plates S, the greater become the impacts and rebounding of jet air. This means that liquids on the surface of a substrate plate S can be scattered around in a conspicuously greater degree.

The inside of the housing of the drying stage 2 is maintained in a positively pressurized state while the inside of the draining stage 1 is maintained in a negatively pressurized state as mentioned above, so that air streams occur in a direction opposite to the substrate transfer direction. Accordingly, droplets and particles of splashed liquid are entrained on the air streams and carried away therewith in the upstream side in the substrate transfer direction. However, if a substrate plate carries a liquid at a large deposition rate on its surface, the liquid can be splashed toward the downstream side. Therefore, it is necessary to suppress the liquid splashing from substrate surfaces to a minimum. For this purpose, the angle of incidence of jet air should preferably be shallower than 45 degrees, more preferably in the range of approximately 35 degrees to 45 degrees as indicated by a solid line in FIG. 6. After a substrate plate S has entered the air blasting zone of the air knife nozzle, the angle of incidence of jet air should be maintained in that condition at least until the rear corner portion $C_3$ of the substrate S gets into the air blasting zone.

As soon as a substrate plate S gets into the air blasting zone fully across its entire width, the blasted air begins to flow along the surface of the substrate plate S, scraping off liquid droplets and films from the substrate surface to dry the same. Accordingly, in this phase of drying, splashing of liquid will not occur even if the angle of incidence of jet air is increased to some extent from the angle of incidence at the plunging point. However, considering that liquid remains on the substrate surface in a relatively large amount up to a halfway point and in order to scrape that liquid off the substrate surface in an assured manner, it is advantageous to keep a shallow angle of incidence, pushing the liquid in a direction opposite to the substrate transfer direction with as large a force as possible.

Figure 7:
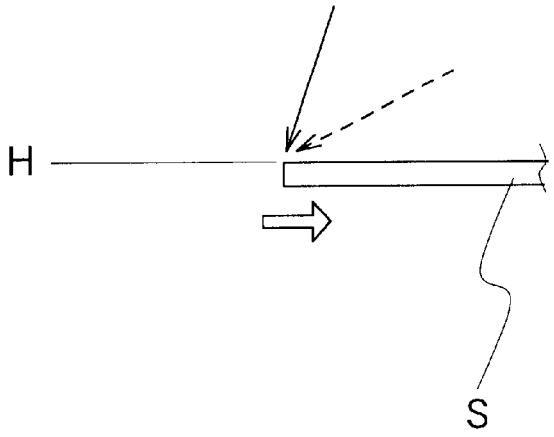
FIG. 7 is a diagrammatic illustration showing the angle of incidence of jet air on a substrate plate leaving an air blasting zone of an air knife nozzle.

By further advancement of the substrate plate S, the rear corner portion $C_4$ is disengaged from the air blasting zone of the air knife nozzle, immediately followed by disengagement of the rear end edge portions $L_1$. At this time, liquid on the substrate plate S is urged to flow toward the rearmost corner portion $C_2$ instead of being purged from the rear end edge portions $L_1$. Besides, part of liquid at the side edge portions $L_2$ is urged to flow toward the rearmost corner portion $C_2$. As a result, liquid concentration takes place in the rearmost corner portion $C_2$. Under such circumstances, if jet air is blasted at a shallow angle of incidence as indicated by a broken line in FIG. 7, it is probable for jet air to flow simply over and along the surface of concentrated liquid, allowing the latter to remain in the corner portion $C_2$. In order to prevent a problem of this sort, the angle of incidence of jet air should rather be made deeper at this point for scraping liquid residues off the edges of the substrate plate S. Namely, to purge concentrated liquid smoothly and quickly, the angle of incidence of jet air should be made deeper. For this purpose, as indicated by a solid line in FIG. 7, jet air should be blasted at an angle of incidence greater than 45 degrees, preferably at an angle of incidence between 45 degrees and 55 degrees.

For the reasons as explained above, according to an embodiment of the present invention, in a drying stage, the angle of incidence of jet air which is blasted on the substrate surface from each air knife nozzle is varied by the use of a descending air angle control means, which is connected to the air knife nozzles 20 of the air knife drier 5 to vary the angle of incidence of jet air on surfaces of substrate plates S in each cycle of drying operation. To serve this purpose, for example, a descending air angle control means of the following construction can be attached to the air knife drier 5.

Figure 8:
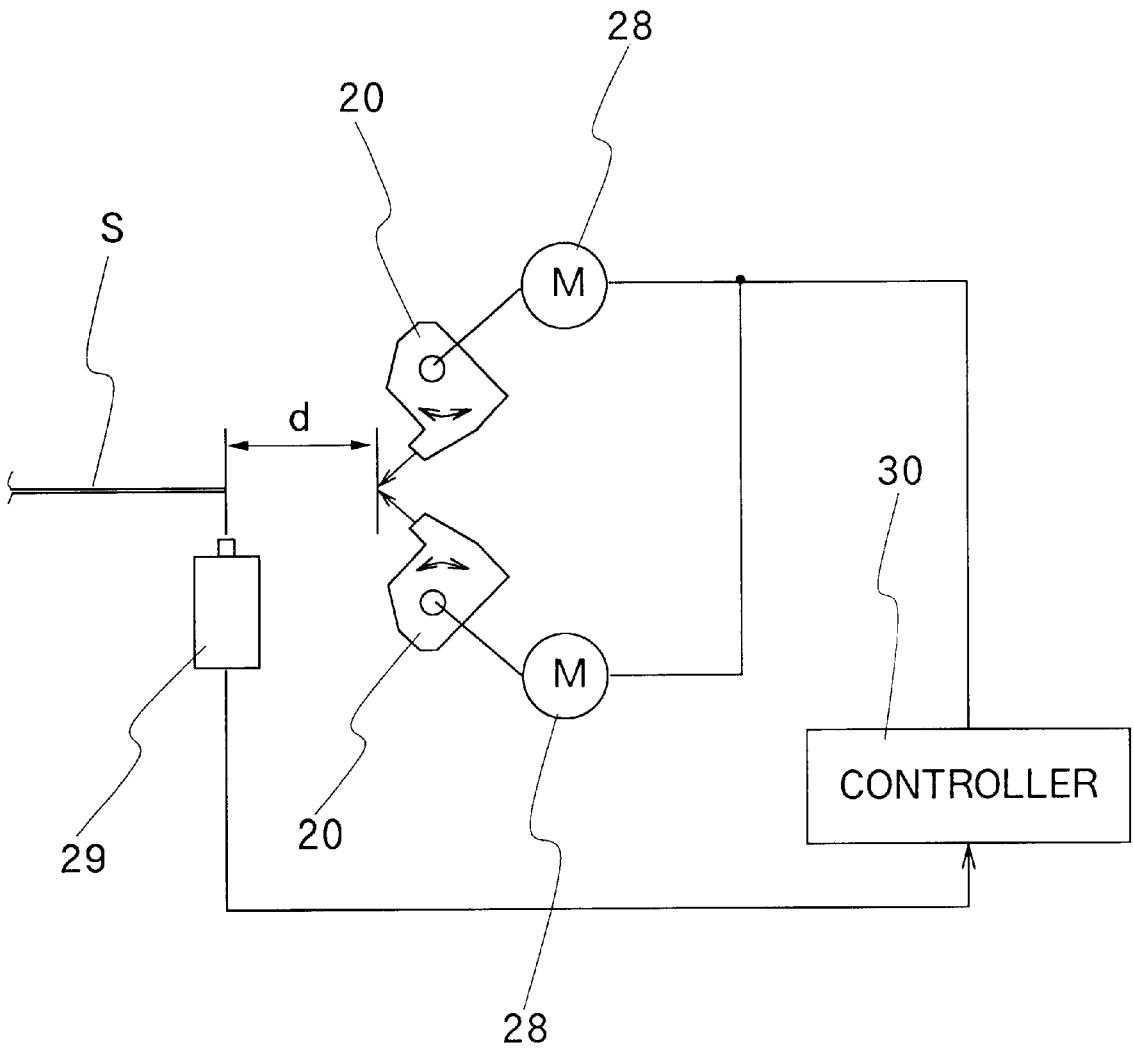
FIG. 8 is a diagrammatic illustration of a nozzle angle controller.

More specifically, as seen in FIGS. 2 and 4 and as shown in FIG. 8, each air knife nozzle 20 is provided with rotational shafts 26*a* and 26*b* which are extended out from the opposite ends of its casing 21 axially in alignment with each other and in parallel relation with the slit-like nozzle mouth 24. Accordingly, upon turning the rotational shafts 26*a* and 26*b*, the nozzle mouths 24 of the air knife nozzles 20 are turned up or down as indicated by arrows in FIG. 8 to vary the angle of incidence of jet air on the surfaces of a substrate plate S, keeping the same distances to substrate surfaces. The rotational shafts 26*a* and 26*b* are rotatably supported on bearing brackets 27*a* and 27*b* which are provided on the opposite sides of the conveyer means 10. A pulse motor 28 which is provided on one bearing bracket 27*a* is coupled with the rotational shaft 26*a*. Accordingly, the air knife nozzle 20 is turned upward or downward by the pulse motor 28 to vary the descending angle of air jet which is spurted toward the substrate plate S from the air knife nozzle 20.

Further, a substrate passage detection means 29 is located at a position which is upstream of the air blasting zone of the air knife nozzle 20 by a predetermined distance d in the direction of substrate transfer by the conveyer means 10. This substrate passage detection means 29 is constituted by a light-transmitting or -reflecting type photo sensor or the like. A detection signal from the substrate passage detection means 29 is fed to a controller 30 which produces control signals for the pulse motors 28.

In operation of the present embodiment, which is arranged as described above, substrate plates S, which have been washed in a preceding washing stage, are transferred forward by the conveyer means 10 and fed into the preliminary draining stage 1 of the drier one after another. In the draining stage, while a wash liquid on a substrate plate S is roughly drained off, pure water is dripped onto the substrate plate S from the pure water dripping means 4 to prevent the substrate from being partially dried. In the preceding washing stage, the substrate plates S can be washed by various methods, for example, washing with roll brushes, washing in showers, ultrasound washing and so forth or by a combination of these washing methods. Past the draining stage 1, the substrate plate S is then transferred into the drying stage 2 through the opening 3*a* in the partition wall 3.

In the drying stage 2, upon detecting passage of a substrate plate S by the passage detection means 29 which is located upstream of the air knife nozzle 20 or more particularly upstream of the air blasting zone of the air knife nozzle 20, the angle of incidence of jet air of the air knife nozzle 20 with respect to the drying surface of the substrate plate S is adjusted to an angle smaller than 45 degrees, for example, to 40 degrees as soon as the passage of the substrate plate S is detected by the passage detection means 29. Namely, upon detecting passage of a substrate plate S, the rotational shafts 26*a* of the air knife nozzle 20 is turned by the pulse motor 28 to adjust the descending angle of air jet from the air knife nozzle 20. In this adjustment, the angle of incidence of jet air on the surface of the substrate plate S is made shallower, so that the jet air is oriented to flow in a direction along the surface of the substrate plate S even if the substrate transfer speed by the conveyer means 10 is increased. As a consequence, jet air is prevented from colliding against the surface of the substrate plate S with strong impacts which would cause splashing of a liquid which remain on the substrate plate S.

The air knife nozzle 20 is retained in the initially adjusted position in terms of the descending angle at least until corner portion $C_4$ of the substrate plate S gets into the air blasting zone of the air knife nozzle 20. By blasting jet air on the substrate plate S from the air knife nozzle 20 at a shallow angle in this manner, liquid droplets and films are scraped off the surface of the substrate plate S by the pressure of jet air and thereby pushed away in a direction opposite to the substrate transfer direction, leaving dried surfaces behind. In this regard, in order to push a liquid long the drying surface of the substrate plate S, it is desirable for the angle of incidence of jet air to be as shallow as possible. Therefore, a shallow jet air descending angle may be retained up to a point where the rear corner portion $C_4$ enters the air blasting zone of the air knife nozzle 20. However, since a liquid on the surface of the substrate plate S is purged from the rear end edge portions L1 and posterior side edge portions L2 and as a result becomes smaller in amount with advancement of the substrate plate S, there will occur no problem in particular even if the descending angle of the air knife 20 is changed to some extent after the corner portion $C_3$ has entered the air blasting zone.

After disengagement of the rear corner portion $C_4$ from the air blasting zone, the rear end edge portions come into the air blasting zone. At this time, if the angle of incidence of jet air is shallow, a liquid which has been pushed as far as the rear end edge portions $L_1$ of the substrate plate S can be increasingly imparted with a tendency of flowing toward the rearmost corner portion $C_2$ along the rear end edge portions L1 instead of being blown off at the rear end edge portions $L_1$. As a result, liquid concentration takes place in the rearmost corner portion $C_2$. Therefore, at latest upon disengagement of the rear corner portion $C_4$ from the air blasting zone, the angle of the air knife nozzle 20 is adjusted to deepen the angle of incidence of jet air on the substrate plate S. By so doing, major part of the liquid which has been pushed as far as the rear end edge portions $L_1$ is scraped off and purged from the substrate plate S at the rear end edge portions $L_1$. Namely, liquid droplets and films can be stripped smoothly in a reliable manner. Above all, at the time of blasting jet air on the rearmost corner portion $C_2$, which is the last corner to disengage from the air blasting zone, the descending angle of the air knife nozzle 20 is increased to a maximum degree, for example, to 50 degrees for scraping a liquid off the rearmost corner portion $C_2$ in a more assured manner, precluding stains of liquid residues which might appear on dried surfaces afterwards.

Thus, in the drying stage 2, a signal which is produced by the passage detection means 29 upon detection passage of a substrate plate S at a point upstream of the air blasting zone of the air knife nozzle 20 is fed to the controller 30, and then a command signal is dispatched from the controller 30 to the pulse motor 28 to turn the air knife nozzle 20 to a minimum descending angle. As soon as ⅓ of the substrate surface is dried by passage through the air blasting zone or as soon as the rear corner portion $C_4$ comes to a point immediately before disengagement from the air blasting zone, the angle of the air knife nozzle 20 is increased gradually or step by step such that it becomes maximum immediately before a point where the rearmost corner portion $C_2$ disengages from the air blasting zone. This control of the jet air descending angle through the air knife nozzle 20 makes it possible to prevent a liquid on a substrate plate S from being splashed or spattered in arbitrary directions at the time when a leading corner portion of the substrate plate S plunges into an air blasting zone of the air knife nozzle 20, and to preclude the occurrence of stains or unevenly dried spots which are attributable to liquid residues lingering on the substrate plate when the rear most corner portion disengages from the air blasting zone of the air knife nozzle 20.

Accordingly, there is no possibility of a liquid re-depositing on once-dried surfaces of a substrate plate even in a case where substrate plates of a large size are transferred at a high speed. Further, substrate plates can be dried free of unevenly dried spots because a liquid can be purged from the rearmost corner portions in an assured manner. Accordingly, it becomes possible to process substrate plates efficiently through the washing and drying stages, permitting to improve the throughput as a whole.

Liquid pattering in random directions or generation of mist, as caused by the impacts of jet air, can be prevented by adjusting the air knife nozzle to blast jet air at a shallow angle of incidence only at the initial plunging point as described above, even if the angle of incidence is deepened to some extent after the leading corner portion of substrate plate had advanced into the air blasting zone past the plunging point. Accordingly, arrangements can be made to guide jet air into a shallow angle of incidence at the point of entry of a substrate plate S into the air blasting zone, while retaining the air knife nozzle or nozzles constantly in a position for an angle of incidence which is necessary for scraping a liquid off the rearmost corner portion which is on the verge of disengagement from the air blasting zone of the air knife nozzle 20.

Further, especially in a case where the air knife nozzle 20 is provided on the upper and lower sides of a substrate plate S to dry the opposite faces of the substrate plate simultaneously, large air turbulence occurs at the intersecting point of jet air from the upper and lower air knife nozzles 20 and in front of a substrate plate advancing toward the plunging point. Therefore, under such conditions, the air turbulence may hinder the jet air from flowing smoothly along the surfaces of a substrate plate S, at a point immediately after an entrance of the substrate plate S into the air blasting zone.

Figure 9:
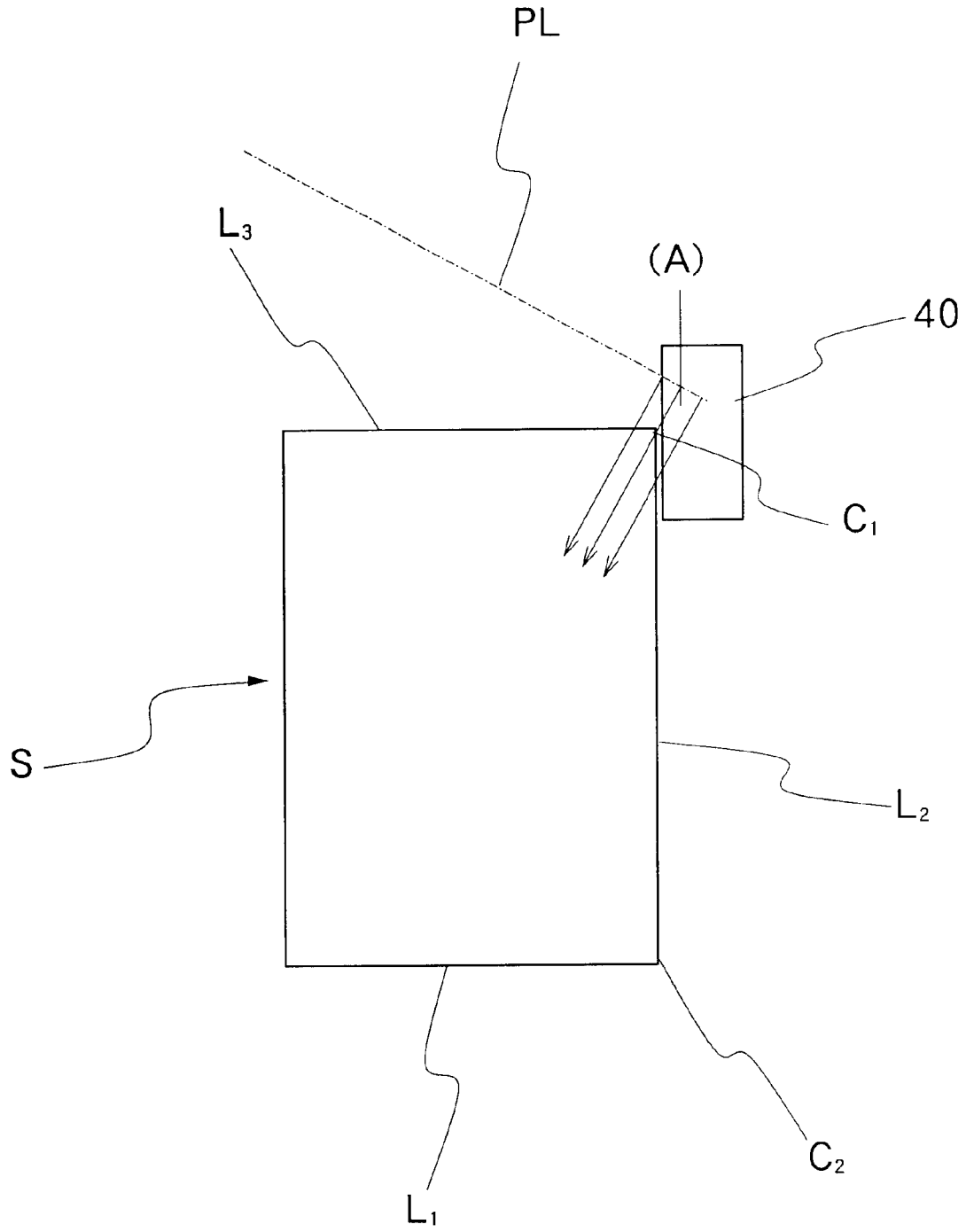
FIG. 9 is a schematic illustration, showing air flow direction in an air blasting zone in a second embodiment of the present invention.
Figure 10:
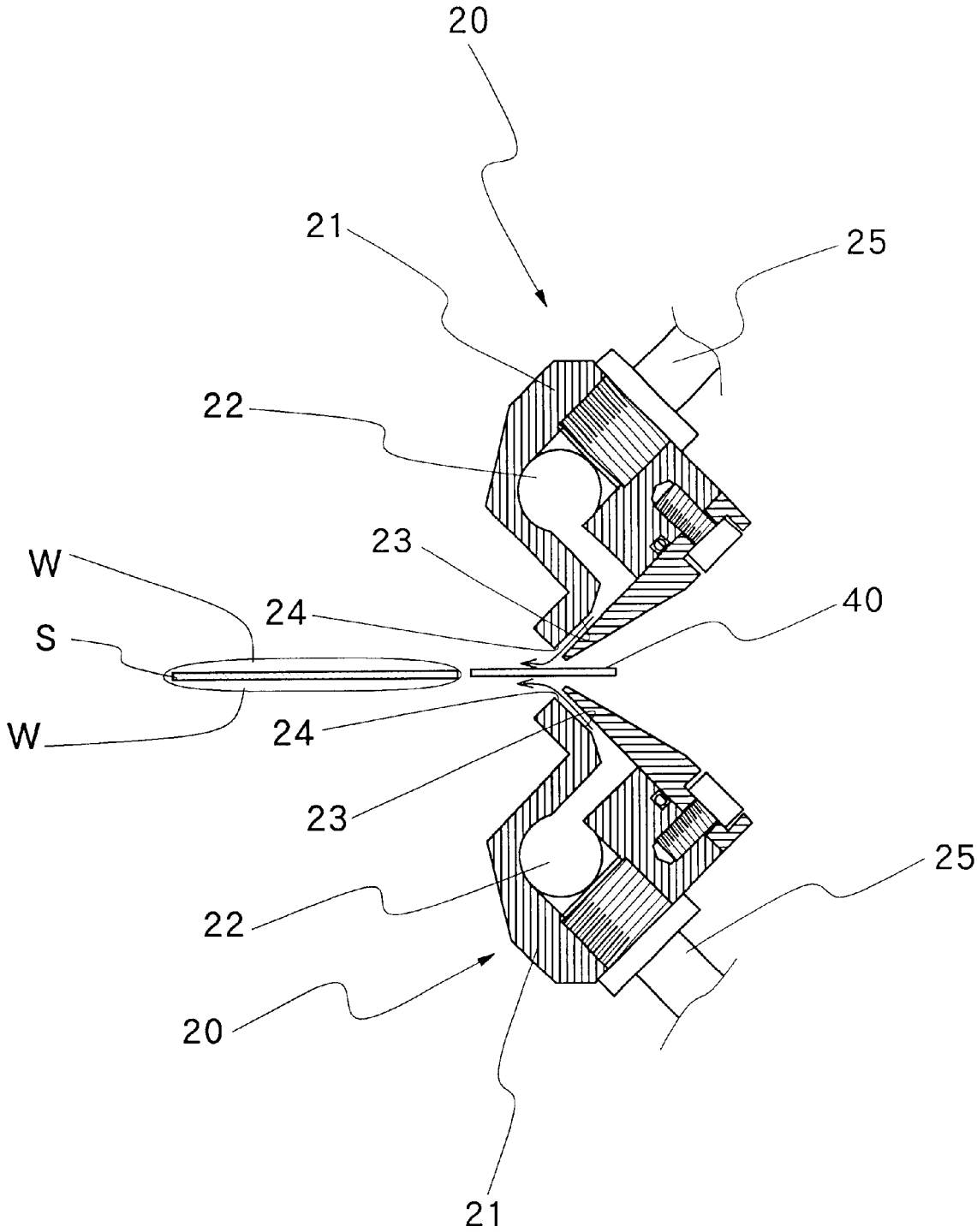
FIG. 10 is a schematic sectional view taken on line A of FIG. 9.

In order to prevent a problem of this sort, a current rectifying plate 40 can be provided between the upper and lower air knife nozzles 20 of the drying stage as shown in FIGS. 9 and 10, in place of or in combination with the jet air descending angle control means, thereby to moderate the angle of incidence of jet air toward a direction parallel with the substrate plate S.

As shown in FIG. 9, the current rectifying plate 40 is constituted by a rectangular plate of the same thickness as the substrate plate S and located fixedly at one side of the path of transfer of the conveyer means and in level with the substrate plates S on the conveyer means, more specifically, fixedly at a position which contains the point of intersection of jet air from the upper and lower air knife nozzles 20 and parallel with edge portions $L_2$ between the two front corner portions $C_1$ and $C_3$ of the substrate plate S. Namely, the current rectifying plate 40 is supported fixedly at a position in the proximity of the edge portions $L_2$ and at the point of intersection PL of jet air from the upper and lower air knife nozzles, free of interference with the transfer of substrate plates S by the conveyer means 10.

A substrate plate S on the conveyer means 10 plunges into the air blasting zone of the air knife nozzles 20 from its leading corner portion $C_1$. At this plunging point, jet air from each air knife nozzle 20 is blasted on the leading corner portion $C_1$ obliquely from front side. In other words, air is blasted on the leading corner portion $C_1$ of a substrate plate S via the current rectifying plate 40 in such a way as to act on a liquid W on the substrate S from front side. Accordingly, in this instance, regardless of the descending angle of the air knife nozzles 20, air is blasted toward the substrate plate S at a shallow angle of incidence as it is rectified in a direction almost parallel with the surfaces of the current rectifying plate 40. In addition, the current rectifying plate 40 separates the jet air from the upper and lower air knife nozzles 20. As a consequence, the jet air from each one of the upper and lower air knife nozzles is prevented from violently colliding against the leading corner portion $C_1$ to such a degree as to scatter a splash or a spatter of a liquid around.

Following the leading corner portion $C_1$, the other front corner portion $C_3$ of the substrate plate S is advanced to plunge into the air blasting zone and blasted with jet air which gets onto the substrate plate S from obliquely fore direction. At this time, jet air may be put in a turbulent condition temporarily immediately before it gets onto the substrate plate S. However, since the removal of liquid has been in progress by the action of air streams along the surfaces of the substrate plate S and the liquid on the substrate plate S has already been stripped to some extent by this time, there is no possibility of turbulent air spattering liquid or generating a mist at the time of entry of the front corner portion $C_3$ into the air blasting zone.

As described above, according to the first embodiment of the present invention, the angle of incidence of jet air from an air knife nozzle is adjusted by way of the jet air descending angle control means, and, according to the second embodiment, it is adjusted by the use of the current rectifying plate 40. Namely, the angle of incidence of jet air from the air knife nozzle 20 is deepened by the descending air angle control means at the time of disengagement of a substrate plate S from an air blasting zone of the air knife nozzle 20 or shallowed by the use of the current rectifying plate 40 at the time of entry of a substrate plate S into the air blasting zone. If necessary, the current rectifying plate 40 may be employed in combination with the jet air descending angle control means. When the descending angle control means and the current rectifying plate are used in combination, it becomes possible to narrow the angular control range of the air knife nozzle 20 by the descending angle control means, which is advantageous from the standpoint of controllability and responsibility in adjusting the nozzle angle.

What is claimed is:

1. An apparatus for drying a substrate plate which is being transferred substantially horizontally by a conveyer means along a predetermined path of transfer, by the use of an air knife nozzle having a slit-like nozzle mouth located at a uniform distance from a drying surface of said substrate plate to spurt a jet of compressed air across width of said substrate plates at a predetermined angle of incidence with respect to a drying surface of said substrate plate from a direction opposite to a transfer direction of said substrate plate to scrape off liquid droplets and films therefrom, characterized in that said apparatus comprises:

an incident air angle control means associated with said air knife nozzle to adjust said angle of incidence of jet air with respect to said drying surface of said substrate plate, said incident air angle control means being adapted to make said angle of incidence shallower as soon as said substrate plate reaches a point of entry into an air blasting zone of said air knife nozzle and to make said angle of incidence deeper at latest immediately before said substrate plate reaches a point of disengagement from said air blasting zone.

2. An apparatus for drying a substrate plate as defined in claim 1, wherein said incident air angle control means is constituted by a descending air angle control means adapted to turn said air knife nozzle to vary a descending angle of jet air spurted from said air knife nozzle.

3. An apparatus for drying a substrate plate as defined in claim 2, wherein said air knife nozzle is located obliquely in a plane parallel with said drying surface of said substrate plate on said conveyer means.

4. An apparatus for drying a substrate plate as defined in claim 2, wherein said descending air angle control means comprises a pair of rotational shafts attached to said air knife nozzle in parallel relation with said nozzle mouth rotatably supporting said air knife nozzle on a bracket, and a rotational drive means coupled with one of said rotational shafts.

5. An apparatus for drying a substrate plate as defined in claim 2, wherein said descending air control means is adapted to adjust said air descending angle to an angle smaller than 45 degrees at a point of entry of said substrate plate into said air blasting zone of said air knife nozzle, and to an angle larger than 45 degrees at the time of disengagement of said substrate plate from said air blasting zone.

6. An apparatus for drying a substrate plate as defined in claim 1, wherein said incident air angle control means is constituted by a current rectifying plate located in said air blasting zone of said air knife nozzle and at one side of said path of transfer of said conveyer means, in parallel relation with side edges of said substrate plate on the side of a leading corner portion thereof to be firstly plunged into said air blasting zone.

7. An apparatus for drying a substrate plate as defined in claim 6, wherein said current rectifying plate is formed substantially in the same thickness and located substantially at the same height as said substrate plate.

8. An apparatus for drying a substrate plate as defined in claim 1, wherein said incident air angle control means is constituted by a descending air angle control means adapted to turn said air knife nozzle to adjust said air descending angle, and a current rectifying plate located in said air blasting zone of said air knife nozzle and at one side of said path of transfer of said conveyer means, in parallel relation with side edges of said substrate plate on the side of a leading corner portion thereof to be firstly plunged into said air blasting zone.

9. An apparatus for drying a substrate plate as defined in claim 1, where is said air knife nozzle is provided on both the upper and lower sides of said path of transfer of said conveyer means.

10. A method for drying a substrate plate which is being transferred in a substantially horizontal state or in a slightly inclined state by a conveyer means along a predetermined path of transfer, by the use of an air knife nozzle adapted to spurt a jet of compressed air at a predetermined angle of incidence with respect to a drying surface of said substrate plate, said method comprising the steps of adjusting said air knife nozzle to make said angle of incidence of jet air from said air nozzle shallower as soon as a leading end of said substrate plate reaches a point of entry into an air blasting zone of said air knife nozzle; and adjusting said air knife nozzle to make said angle of incidence of jet air deeper at latest when said substrate plate comes to a position immediately before a point of disengagement from said air blasting zone of said air knife nozzle.

11. A method for drying a substrate as defined in claim 10, further comprising the step of adjusting said air knife nozzle to vary said angle of incidence continuously or stepwise toward said point of disengagement from a predetermined position of said air blasting zone between said point of entry and said point of disengagement.

* * * * *

UNITED STATES PATENT AND TRADEMARK OFFICE

CERTIFICATE OF CORRECTION

PATENT NO. : 6,421,932 B2
DATED : July 23, 2002
INVENTOR(S) : Kazuhiko Gommori et al.

It is certified that error appears in the above-identified patent and that said Letters Patent is hereby corrected as shown below:

Title page,
Item [30], Foreign Application Priority Data, should read:
-- [30] Foreign Application Data
Feb. 14, 2000 (JP) ..... 2000-034755
Sep. 29, 2000 (JP) ..... 2000-298615 --

Signed and Sealed this

Seventh Day of January, 2003

JAMES E. ROGAN
*Director of the United States Patent and Trademark Office*